United States Patent [19]

Bulman

[11] Patent Number: 4,993,309

[45] Date of Patent: Feb. 19, 1991

[54] LIQUID PROPELLANT WEAPON SYSTEM

[75] Inventor: Melvin J. Bulman, Colchester, Vt.

[73] Assignee: General Electric Company, Pittsfield, Mass.

[21] Appl. No.: 471,310

[22] Filed: Jan. 22, 1990

Related U.S. Application Data

[62] Division of Ser. No. 300,638, Dec. 18, 1988, which is a division of Ser. No. 150,351, Dec. 16, 1987, Pat. No. 4,852,458.

[51] Int. Cl.[5] ..... F41F 1/04; F42B 5/16

[52] U.S. Cl. ..... 87/7; 102/440

[58] Field of Search ..... 89/7, 8; 102/440

[56] References Cited

U.S. PATENT DOCUMENTS

| | | | |
|---|---|---|---|
| 3,783,737 | 1/1974 | Ashley | 89/7 |
| 4,011,817 | 3/1977 | Ashley | 89/7 |
| 4,050,348 | 9/1977 | Graham | 89/7 |
| 4,051,762 | 10/1977 | Ashley | 89/7 |
| 4,085,653 | 4/1978 | Tassie et al. | 89/7 |
| 4,102,269 | 7/1978 | Ashley | 89/7 |
| 4,478,128 | 10/1984 | Black et al. | 89/7 |

*Primary Examiner*—David H. Brown

*Attorney, Agent, or Firm*—Bailin L. Kuch

[57] ABSTRACT

This invention provides a liquid propellant round of ammunition having a traveling charge which is ignited after both such charge and the projectile have received an initial forward acceleration.

1 Claim, 15 Drawing Sheets

LIQUID PROPELLANT WEAPON SYSTEM

This is a divisional of co-pending application Ser. No. 07/300,638 filed on Dec. 18, 1988, which is a divisional of copending application Ser. No. 07/150,351 filed on Dec. 16, 1987, now U.S. Pat. No. 4,852,458 issued Aug. 1, 1989.

BACKGROUND OF THE INVENTION

1. Field of the Invention

This invention relates to weapon systems employing a liquid propellant, and particularly to such systems wherein the propellant is progressively combusted aft of the projectile as the projectile advances along the firing bore, i.e. a traveling charge system.

This invention also relates to such a system utilizing an initial source of combustion gas to provide an initial acceleration to the projectile and its traveling charge.

2. Prior Art

The classical propulsion of a projectile within the bore of a gun barrel is limited in velocity by the need to accelerate the combustion gases to the velocity of the projectile. This results in an increasingly large fraction of the thermodynamic expansion work being expended on accelerating the combustion gases. Normal ballistic models increase the apparent mass of the projectile by one-third the mass of the propellant. This assumption accounts for the kinetic energy imparted to the gases. For typical guns, the kinetic energy of the gases only amounts to about 10% at a velocity of 1000 m/sec. At 2000 m./sec. the fraction increases to approximately 50%. As the velocity approaches 3,000 m./sec. the gas kinetic energy approaches 100% (nothing left for the projectile.) This effect produces what is called the "limit velocity" beyond which a conventional gun propulsion system cannot operate. The Traveling Charge Propulsion system provides a theorectical means around this limit.

As shown in FIGS. 1 and 2, in a traveling charge propulsion system, part or all of the charge C travels down the bore of the gun barrel with the projectile P. Propulsion occurs by the rapid combustion of the charge in the rear portion of the charge, sometimes called "cigarette burning". The reference frame shown in FIG. 1 is taken as moving with the projectile P, wherein:

$A_{BORE}$=cross-sectional area of the bore
$L_{cp}$=length of charge of propellant
$\rho_p$=density of the propellant
$\rho_g$=density of the combustion gas
$\ddot{A}$=acceleration of the projectile
$\mathring{M}$=burn rate of the propellant [slugs/sec]
$P_{BASE}$=pressure at the base of the projectile
$P_L$=pressure at the interface of the propellant and the combustion gas
$P_w$=pressure at the exit of the combustion zone
$\mathring{r}$=linear burn rate of the propellant
$V_j$=exhaust velocity of the combustion gas at the exit of the combustion zone The accelerating force on the projectile and the traveling charge is made up of two terms. The first term can be referred to as the "pressure" term, where the combustion of the charge produces an elevated pressure at the exit of the combustion zone. The second term can be referred to as the "thrust" term, where the thrust is the result of the momentum of the combustion gas exiting the combustion zone:

$$P_L = P_w + \frac{\mathring{m}\, V_j}{A_{BORE}}$$

Both of these terms increase as the rate of combustion increases. The total thrust divided by the mass consumption rate is referred to as the "specific impulse" (a rocket term). It can be shown that this parameter is a maximum when the gas velocity is greatest. Since this combustion is taking place in a constant area duct (Rayleigh flow) the maximum velocity is the sonic velocity. Under these conditions, typically 200 pounds of total thrust is generated for each pound of propellant consumed per second. For a 30 mm weapon to produce 50,000 lbs. of thrust, a consumption rate of 250 lb./sec. is required. This consumption rate requires a linear burn rate of approximately 300 ft./sec. Since normal solid propellants only burn at approximately 1 foot per second at gun pressures, it is apparent why the concept of solid propellant traveling charge propulsion has yet to be made workable.

The use of liquid propellant for a traveling charge system has been proposed previously.

In U.S. Pat. No. 4,011,817, issued Mar. 15, 1977, E. Ashley disclosed a system which utilized the difference in density between the combustion gases and the charge of liquid propellant as the source of energy for the injection of propellant into the combustion chamber. A primer provided the initial acceleration of a cavity generator. A charge of liquid propellant aft of the projectile flowed relatively aftwardly past the cavity generator into the combustion chamber which was formed by and was aft of the cavity generator. The velocity provided by the primer was in the order of hundreds of feet per second.

In U.S. Ser. No. 255,065 filed Apr. 3, 1981, M. J. Bulman disclosed another system which utilized liquid propellant to provide a traveling charge to a projectile.

The major drawback to the liquid propellant bulk loaded approach as disclosed, for example, in U.S. Pat. No. 4,085,653, issued to D. P. Tassie et al on Apr. 25, 1978, is poor control over combustion. The combustion in a bulk loaded gun is largely the result of the growth of fluid dynamic instabilities. A large burning rate is required before there is any acceleration of the projectile and this amplifies any variations in the ignition system.

FIG. 3A shows a typical bulk loaded liquid propellant Gun prior to ignition. The cylindrical chamber is completely filled with liquid propellant. The forward end of the chamber is closed by the base of the projectile. The projectile is seated in the forcing cone of the barrel. The rear of the chamber is closed by a bolt containing the igniter. When the igniter is energized, a jet of hot gases emerges from the igniter vent (see FIG. 3B). This jet, as it enters the chamber must displace propellant in the chamber. Since the chamber is initially constant in volume, this displaced propellant must compress the remaining liquid. Even a small compression will produce a large pressure rise in the liquid. For example, if the igniter jet occupies 1% of the chamber volume, a pressure rise of several thousand pounds per square inch results. Ignition of the main charge of liquid propellant occurs on the surface of this expanding bubble of hot igniter gases. The projectile starts moving when the gas bubble has grown to no more than a few percent of the chamber volume with a nominal surface area which is less than the area of the base of the projectile. In order to sustain a rising pressure in the face of the rapid acceleration of the projectile, the actual burning surface must be 100–1000 times the nominal value. This is achieved in the bulk loaded cycle by the violent interaction between the igniter jet and the liquid propellant. The shearing of the liquid surface by the penetration of the igniter jet produces a rough surface akin to ocean waves on a windy day (the Helmholtz instability—see FIGS. 3C and 3D). If insufficient surface area is generated, projectile forward motion will result in a declining pressure and very poor performance. If too much surface area is generated, dangerously high levels of pressure will occur. Since the surface area generation is the result of great amplification in these fluid mechanical instabilities, slight variations in any part of the process will have a major impact on the pressures generated.

To illustrate the sensitivity to variations in the process, it can be shown that combustion of only 1% of the charge before projectile forward motion can produce a pressure rise in excess of 100,000 PSI (which is often seen). FIG. 4 shows a typical bulk loaded pressure time curve.

Accordingly, it is an object of this invention to provide a bulk loaded, liquid propellant gun system having controlled ignition and combustion which provide an improved traveling charge to propel the projectile.

Another object is to provide a liquid propellant gun system with an improved control over ignition and combustion which avoids the strong feedback present in the conventional bulk loaded cycle.

A feature of this invention is the provision of a liquid propellant gun system having a traveling charge which is ignited after both such charge and the projectile have been accelerated forwardly.

BRIEF DESCRIPTION OF THE DRAWING

These and other objects, advantages and features of the invention will be apparent from the following specification thereof taken in conjunction with the accompanying drawing in which.

DESCRIPTION OF THE EMBODIMENTS

Figure 1:
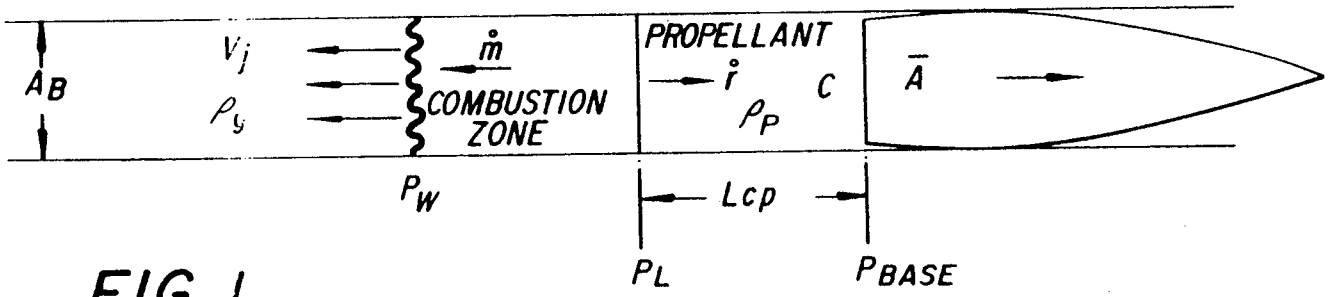
FIG. 1 is a schematic of a generalized traveling charge system.
Figure 2:
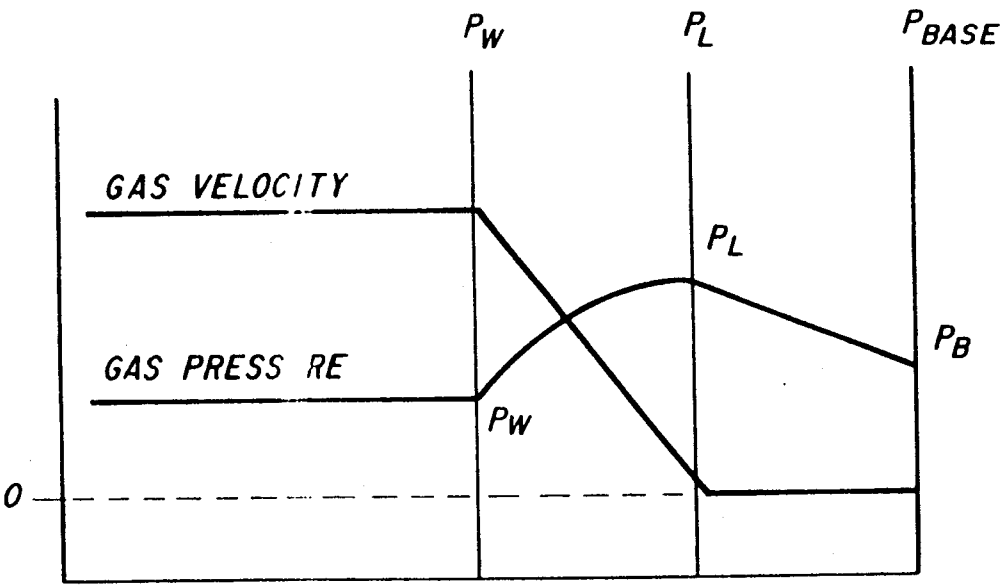
FIG. 2 is a chart of the velocity and pressure along the length of the system of FIG. 1.
Figure 3A:
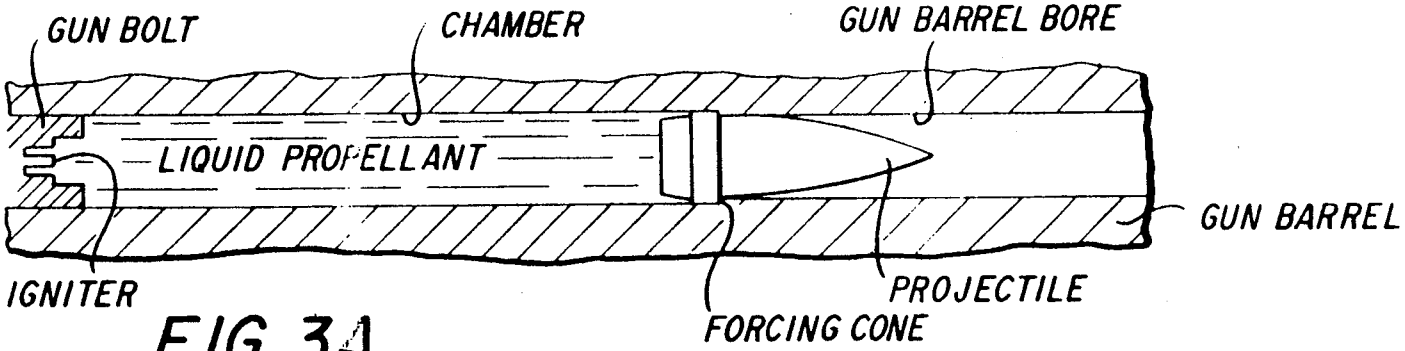
FIG. 3A is a schematic of a generalized bulk loaded liquid propellant system prior to ignition.
Figure 3D:
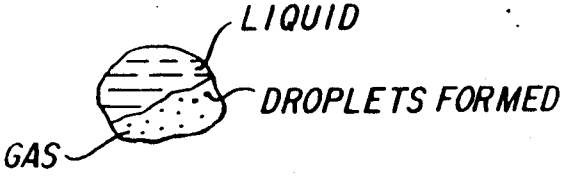
FIG. 3D is a detail of FIG. 3A showing the liquid-gas interface.
Figure 3C:
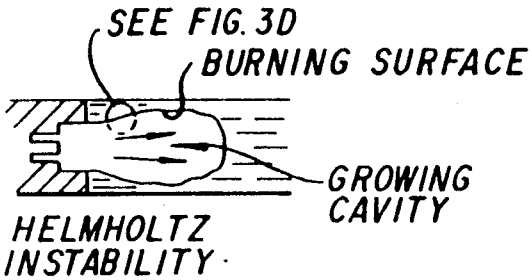
FIG. 3C is a detail of the system of FIG. 3A showing the conversion of the igniter jet into the combustion gas bubble.
Figure 3B:
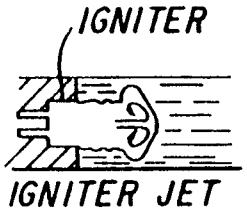
FIG. 3B is a detail of the system of FIG. 3A showing the development of the igniter jet.
Figure 4:
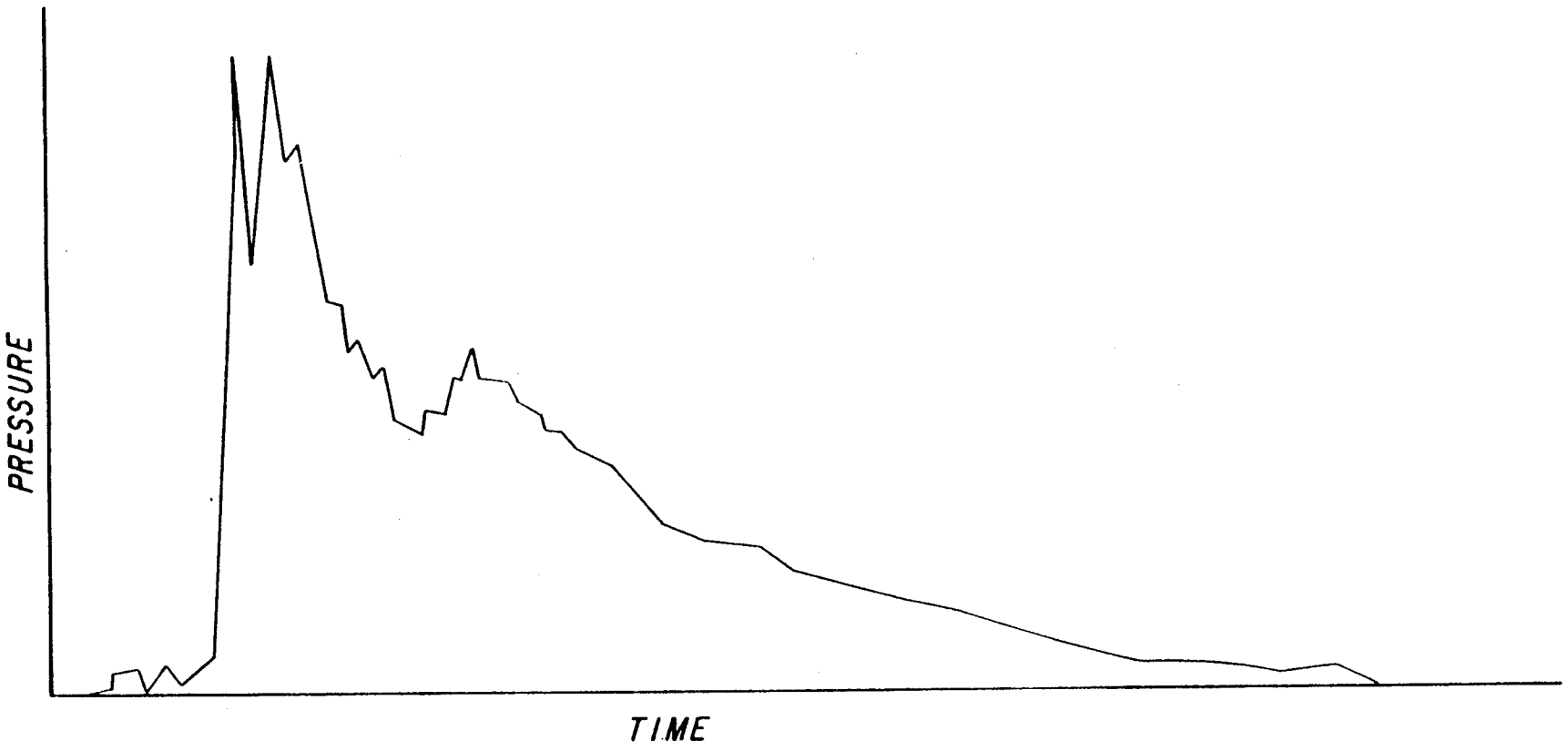
FIG. 4 is a chart showing time versus pressure of a firing of a typical bulk loaded liquid propellant system.

The characteristics of a traveling charge propulsion system include:

1. Transport (i.e. traveling) of a charge of propellant forwardly along the gun barrel bore (i.e. down-bore) with the projectile, with the combustion of the charge of propellant providing additional acceleration to the combined mass of the charge of propellant and the projectile.
2. Modification of the conventional down-bore gradient in pressure by the combustion of the traveling charge of propellant.
3. Enhancement of performance compared to the propulsion provided by a conventional system using an equivalent charge of propellant.

These characteristics have already been demonstrated by the system disclosed in U.S. Ser. No. 255,065, supra. In certain embodiments of that system the projectile is incorporated into a sabot, which sabot adds its weight to the accelerated mass. This invention avoids such an added weight.

This invention may be denominated the Fractional Traveling Charge [FTC] propulsion system. In the FTC system, a bulk loaded liquid propellant traveling charge and the respective projectile are both provided with an initial acceleration and the charge is not ignited until both the charge and projectile have achieved significant velocity. This delayed ignition provides two benefits:

1. Propulsion efficiency is improved by increasing the magnitude of the velocity range through which the traveling charges operates.
2. The delayed ignition avoids the instabilities encountered in the conventional ignition of a confined stationary charge.

The initial acceleration of the combined masses of the traveling charge and the projectile can be provided by any convenient means. For examples, an initial charge of solid propellant, or an initial charge of liquid propellant. If liquid propellant is chosen, it may be utilized in a regenerative injection liquid propellant combuster built into the overall gun system. This combuster is made of a size adequate to accelerate the combined masses of both the traveling charge and the projectile to a velocity of approximately 1 km/sec before ignition of the traveling charge. This requires the volume of the initial charge to be of the same order of magnitude as the volume of the traveling charge. (The traveling charge will normally be between $\frac{1}{3}$ and $\frac{2}{3}$ of the total charge depending on the performance level of the gun system.)

A first embodiment of this invention is shown in FIGS. 5 through 12. This first embodiment is a gun having a totally integrated, two stage propulsion system incorporating a regeneratively injected first stage and a traveling charge second stage.

The gun includes a breech 10 which is fixed, as by mutual threads 12, to a gun barrel 14. The barrel has an aft chamber 16, an intermediate forcing cone 18, and a forward, not necessarily rifled, bore 20. The breech 10 has an aperture 22 which may be closed by a gun bolt 24 having a truncated cone forward portion. The breech has a groove 26 and the bolt has a groove 28 which may mutually receive a guillotine type lock 30 to lock the bolt to the breech. Alternatively, a cam controlled iris-slide of the type disclosed in U.S. Pat. No. 3,772,959, issued Nov. 20, 1973 to D. P. Tassie, may be utilized. An annular fill valve slide 32 is telescopically journaled on the breech end portion 14A of the barrel 14, and an annular regenerative piston 34 is telescopically journaled on the slide 32. Substantially as disclosed in U.S. Ser. No. 263,792, filed May 14, 1981 by M. J. Bulman, liquid propellant may be provided into the gun from a supply 36, through a fill valve 38, through manifold 40, through a plurality of bores 42, through a manifold 44, and through a plurality of longitudinal bores 48. An ignition device 50, of the type disclosed in Ser. No. 263,792, supra, may be mounted through the breech 10.

Figure 5:
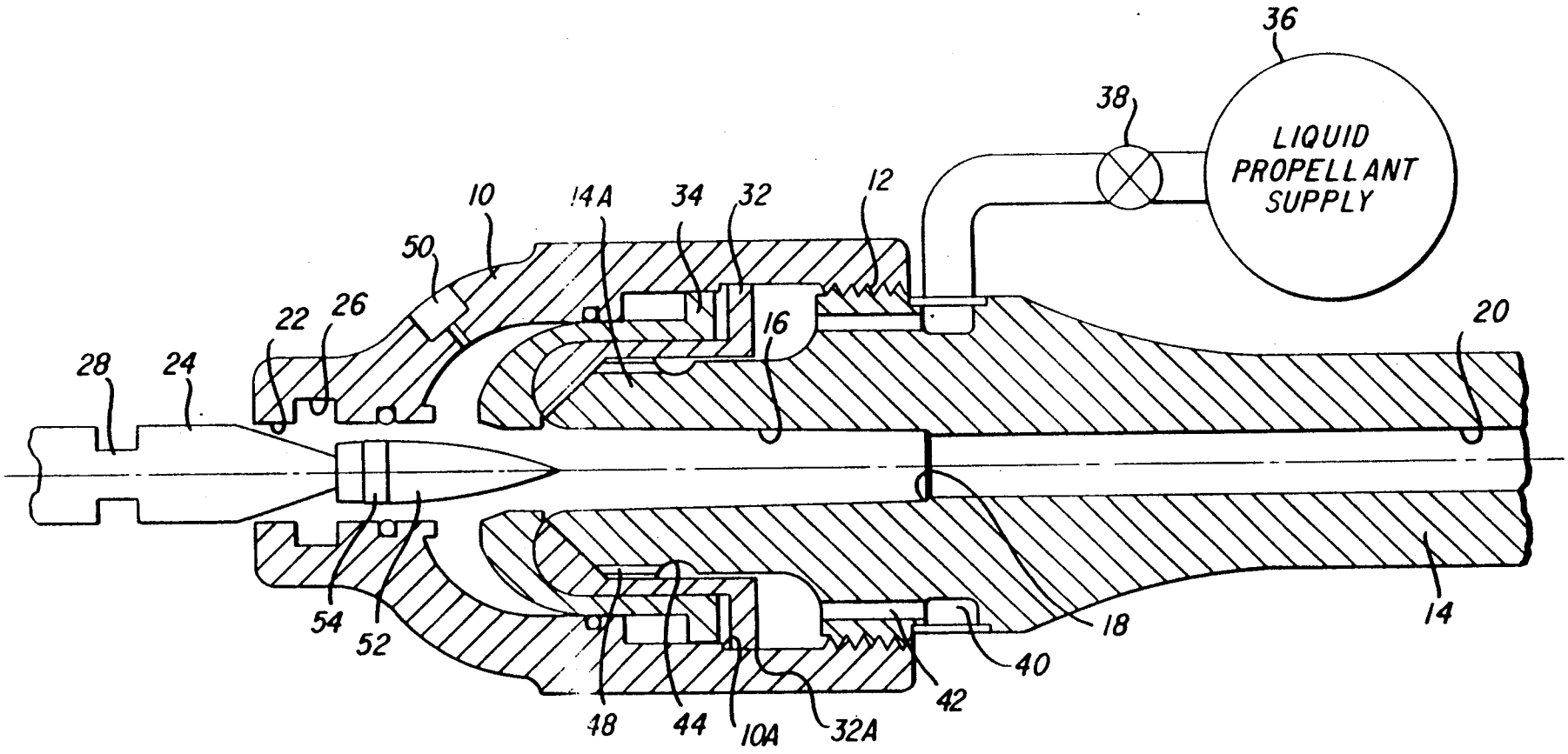
FIG. 5 is a view in longitudinal cross section of liquid propellant system embodying a first species of this invention, showing an intermediate stage of the insertion of the projectile by the gun bolt.

FIG. 5 shows the loading of a projectile 52, having a driving band 54; through the aperture 22 by the gun bolt 24.

Figure 6:
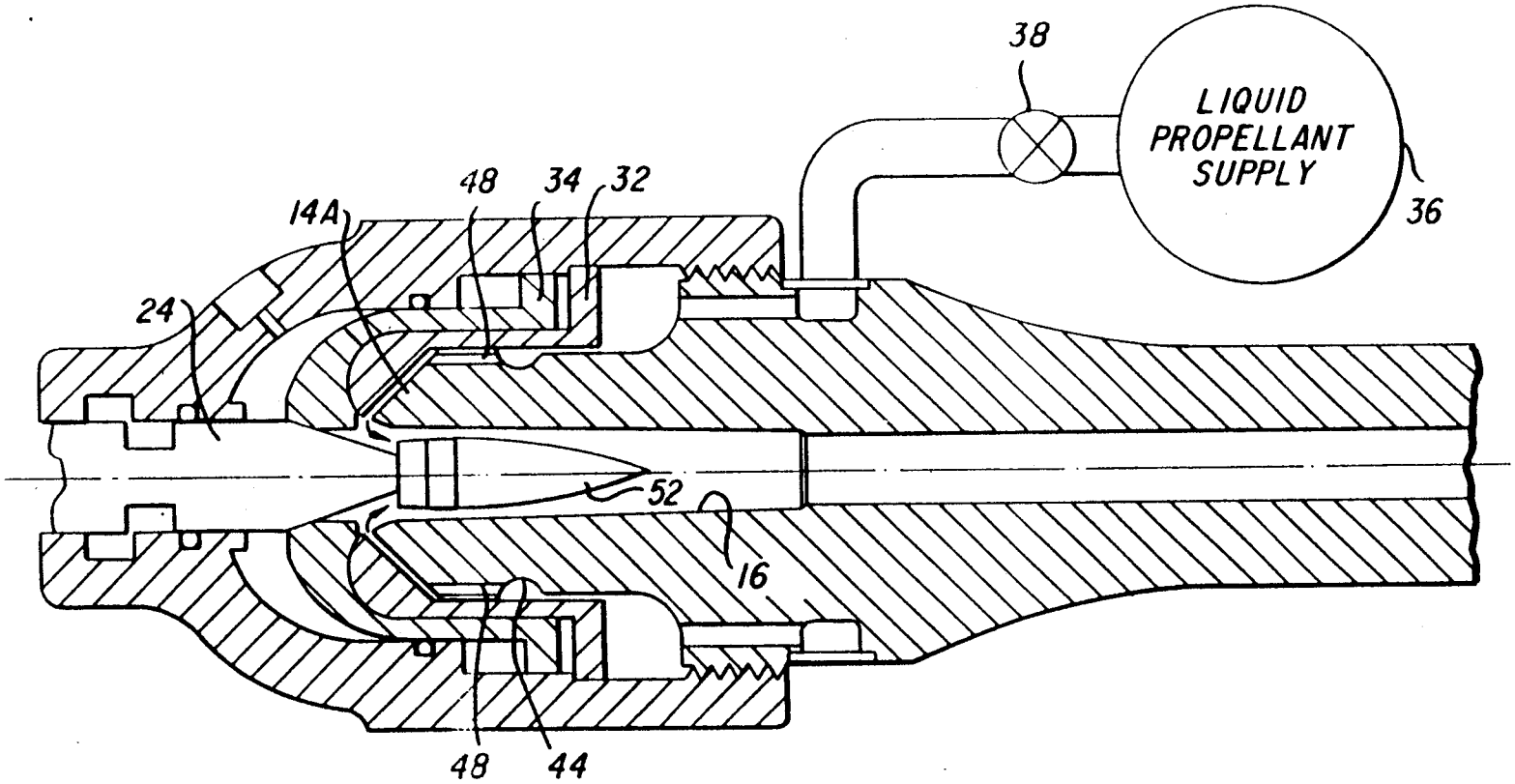
FIG. 6 is a view similar to FIG. 5 showing the completion of the insertion of the projectile by the gun bolt and the commencement of the insertion of the liquid propellant.

FIG. 6 shows the bolt advancing forwardly and ramming the projectile into the chamber 16. The fill valve 38 opens to admit liquid propellant under pressure from the supply 36, through the manifold 40 and the bores 42, displacing the slide 32 and the piston 34 aftwardly, through the manifold 44 and the bores 48 and through the interface gap between the aft face of the portion 14A and the forward face of the head of the fill valve slide 32 into the cavity defined between the projectile 52 and the forward end of the gun bolt 24. The size of the gap is limited by a flange 32A on the valve 32 abuting a step 10A in the breech.

Figure 7:
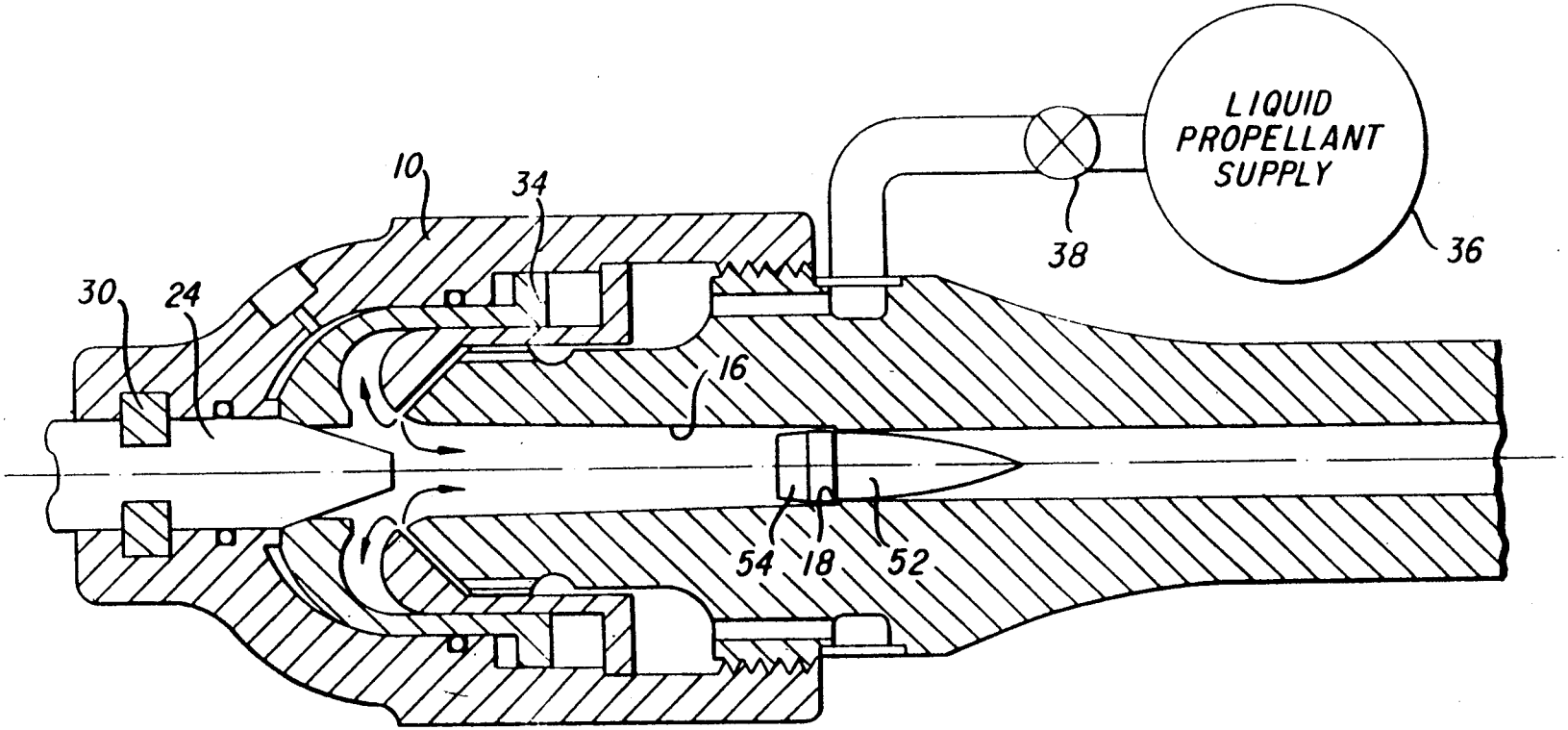
FIG. 7 is a view similar to FIG. 5 showing the completion of the insertion of the liquid propellant, the projectile rammed forward and the bolt locked aft.

FIG. 7 shows the flow of propellant displacing the projectile forwardly in the chamber 16 to lodge the band 54 against the forcing cone 18; and displacing the regenerative piston 34 aft. The bolt 24 is displaced aftwardly and is locked to the breech 10 by the guillotine lock 30. Thereafter, the valve 38 is closed.

Figure 8:
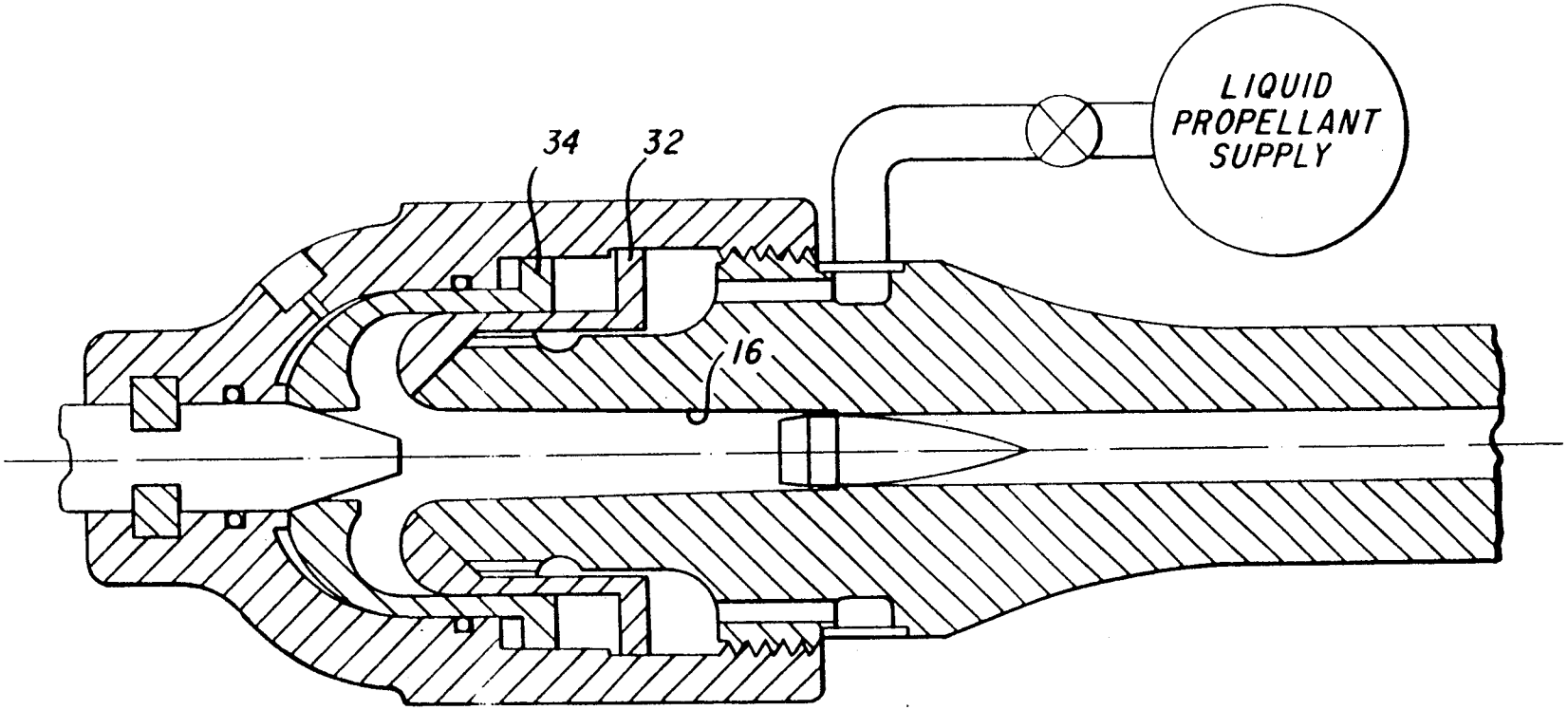
FIG. 8 is a view similar to FIG. 5 showing the commencement of ignition.

FIG. 8 shows the gun ready to fire. The traveling charge is that volume of liquid propellant substantially contained within the chamber 16 aft of the projectile. The stationary (or initial) charge is that volume of liquid propellant substantially contained between the head of the regenerative piston 34 and the head of the fill valve slide 32.

Figure 9:
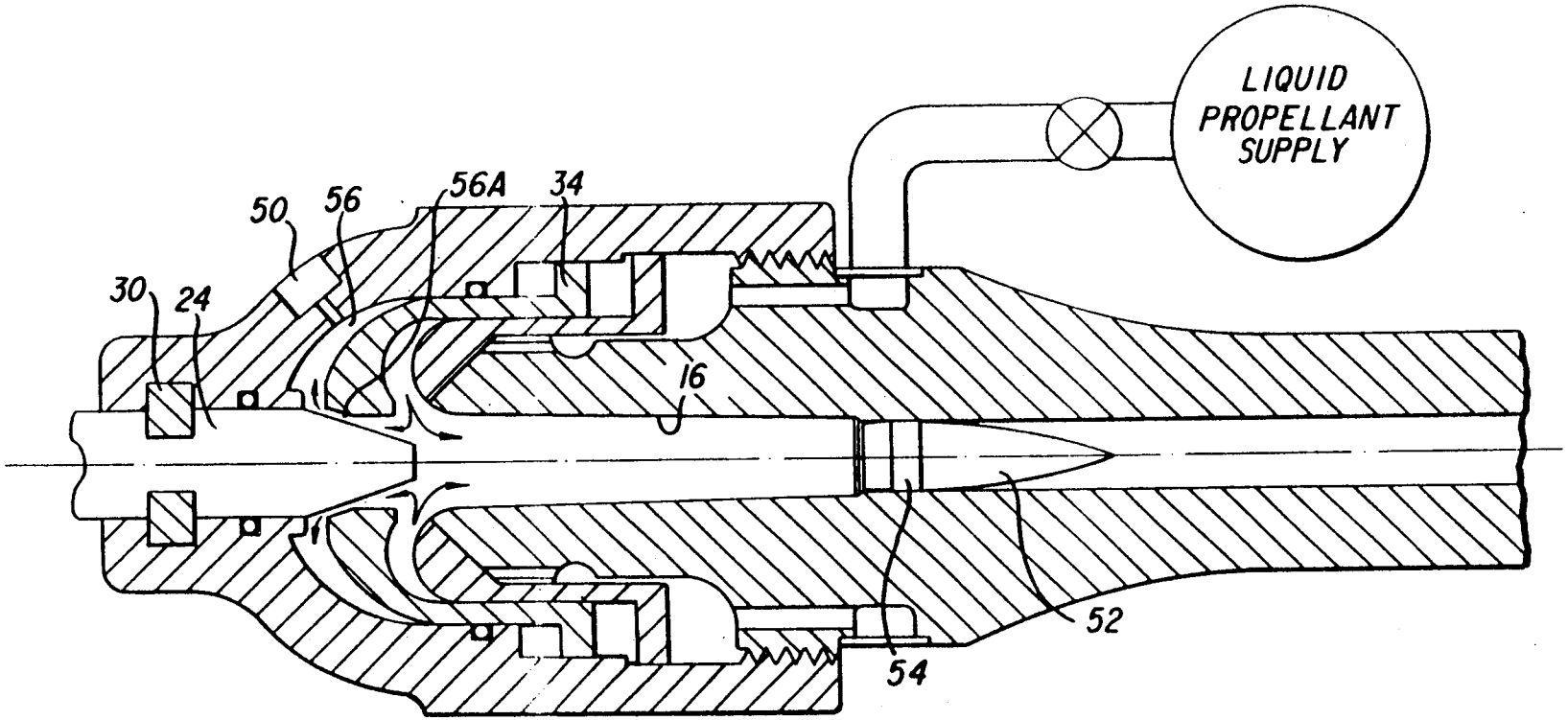
FIG. 9 is a view similar to FIG. 5 showing the regenerative injection stage of combustion.

FIG. 9 shows the gun after ignition, provided by the ignition device 50, which has generated combustion gas in the combustion chamber 56 aft of the head of the regenerative piston 34, to push the piston forwardly against the initial charge contained between the heads, to generate increasing pressure in the stationary charge and the traveling charge. Further, as the head of the piston moves forwardly away from the cone of the gun bolt head it opens up an annular gap 56A which serves as injection port for propellant to flow aftwardly into the combustion chamber 56. This regenerative injection is a result of the forward face of the head of the piston 34 having a smaller transverse cross-sectional area than the aft face of the head, to provide a differential, forwardly directed force on the head. This differential force generates a high pressure on the stationary charge which flows aftwardly, through the injection port 56A into the combustion chamber 56 to sustain, or to increase, the combustion gas pressure. When the pressure on the traveling charge exceeds the shot start pressure (i.e. the pressure to engrave the band 54) the traveling charge and the projectile begin to accelerate past the forcing cone and beyond under the hydraulic influence of the regenerative first stage. The two volumes fore and aft of the head of the piston 34 and the gap 56A interconnecting them may be considered a complex, self feeding, self limiting, combustion engine, i.e., a means for providing combustion.

Figure 10:
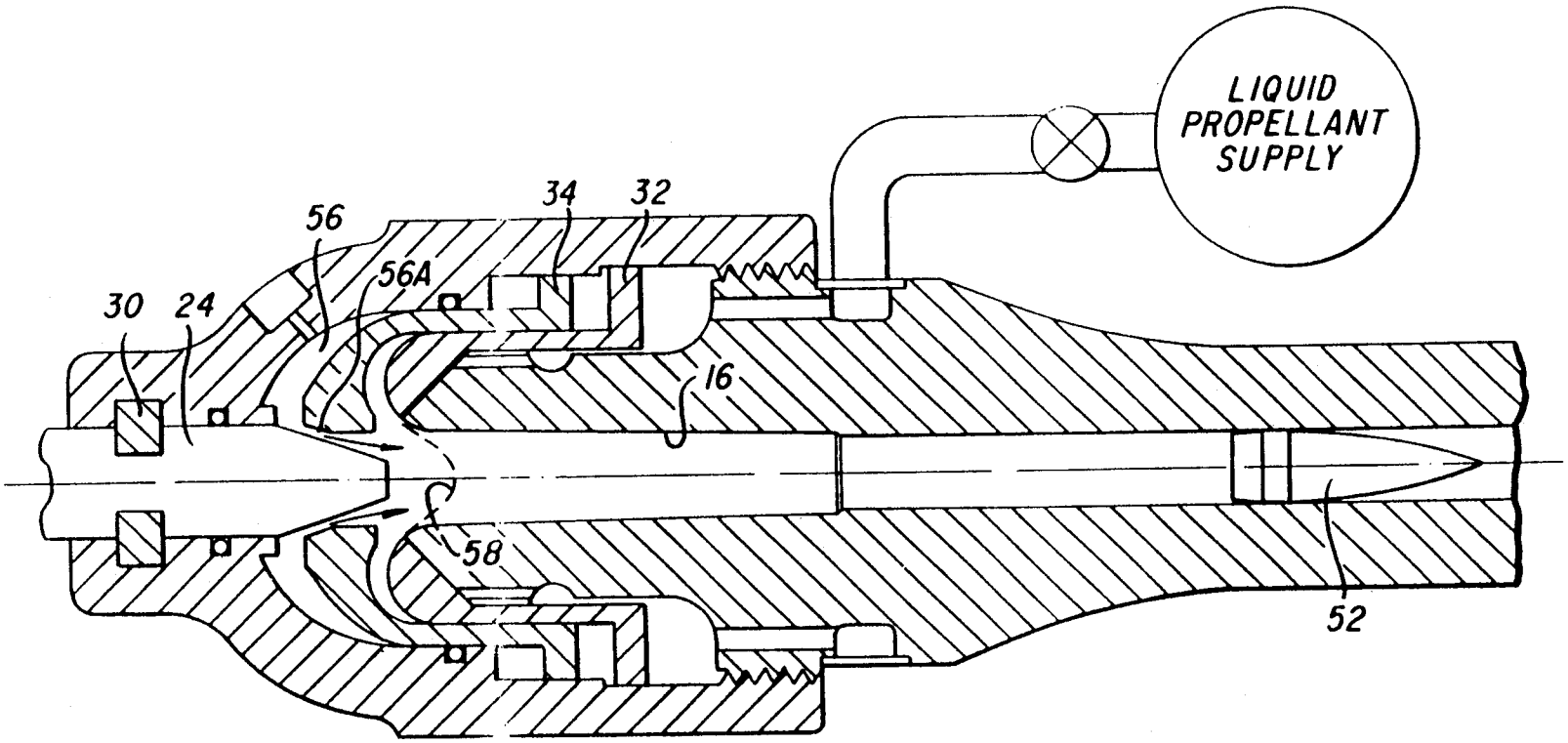
FIG. 10 is a view similar to FIG. 5 showing the transfer to the traveling charge stage of combustion after the initial acceleration of the projectile and the charge immediately aft of the projectile.

FIG. 10 shows the head of the piston 34 near the end of its forward stroke towards the head of the fill valve slide 32. The piston is decelerated by the flow exit area resulting from its shape and closing proximity to the head of the slide. This deceleration reduces the rate of flow of propellant from the stationary charge into the chamber 16 to cause the pressure in the volume of liquid propellant in the chamber 16 to fall below the pressure in the volume of combustion gas in the combustion chamber 56. This pressure differential permits the combustion gases to flow forwardly from the combustion chamber 56 through the injection port 56A into the chamber 16 to form an initial cavity 58 in the aft face of the volume of the traveling charge of liquid propellant in the chamber 16.

Figure 11:
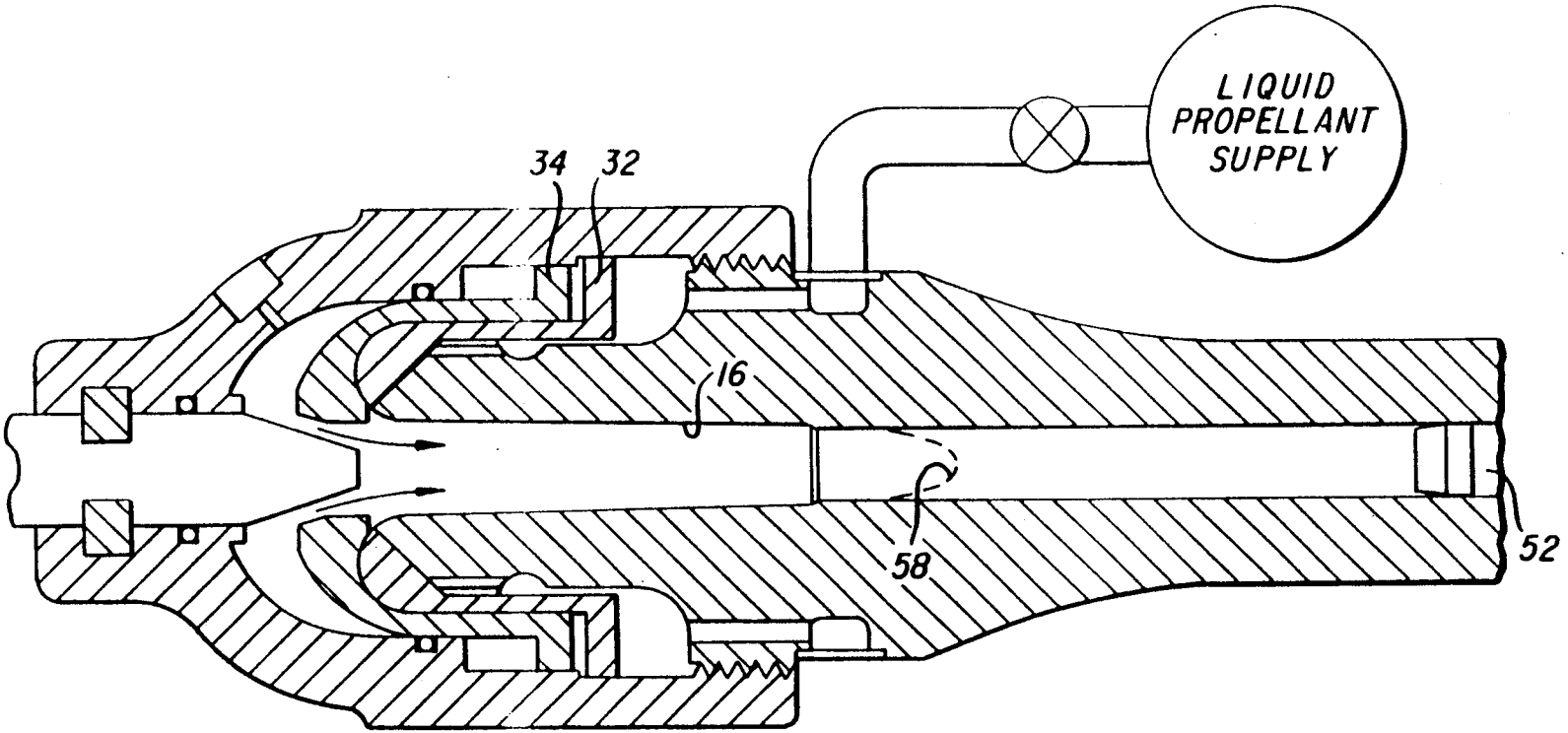
FIG. 11 is a view similar to FIG. 5 showing the traveling charge stage after further acceleration of the projectile.

FIG. 11 shows the initial cavity advancing rapidly forwardly (down-bore) as the regenerative injection stage ceases and the demand for forward flow of liquid propellant by the accelerating projectile continues. This arrangement provides an inherent delay in the start of the traveling charge stage of operation.

Figure 12A:
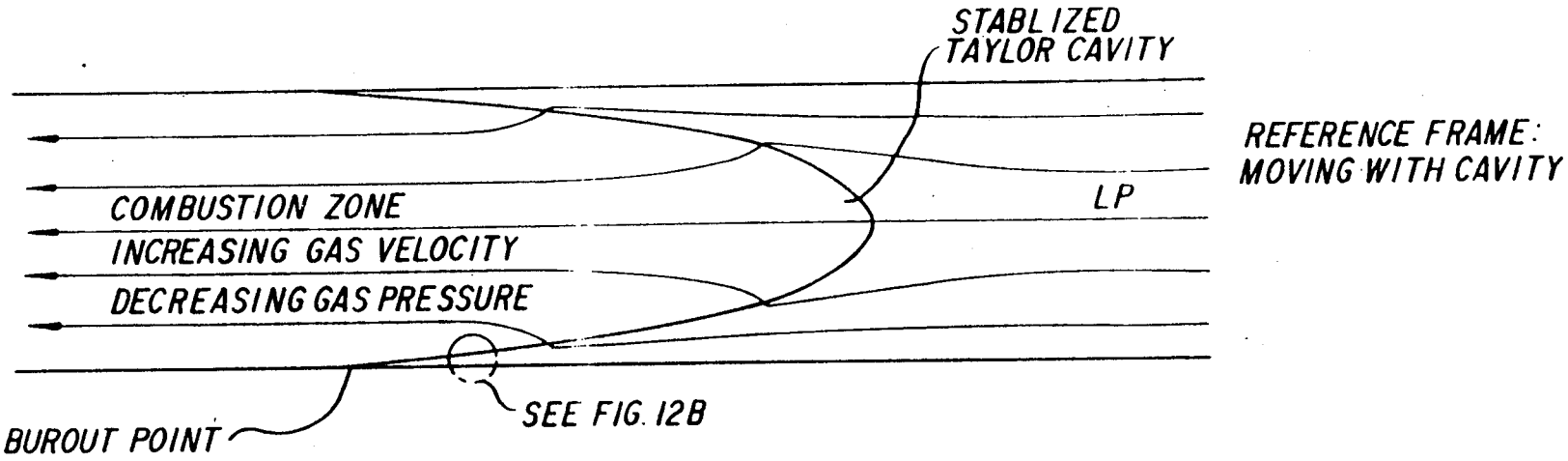
FIG. 12A is a schematic of a stabilized Taylor Cavity.
Figure 12C:
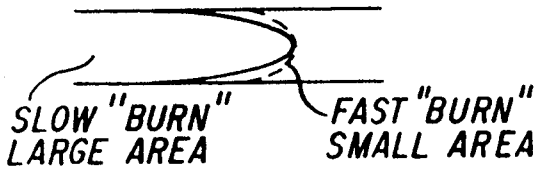
FIG. 12C is a schematic similar to FIG. 12A comparing a slow burning cavity with a fast burning cavity.
Figure 12B:
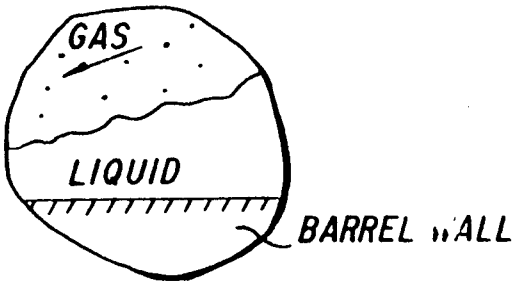
FIG. 12B is a detail of the schematic of FIG. 12A showing the gas/liquid interface of the cavity.

FIG. 12A shows the formation of a stabilized Taylor Cavity which moves forwardly with and towards the projectile. Most of the combustion occurs on the side of the cavity where the relative velocity between the gas and the liquid is high, as shown in FIG. 12B. Combustion here is similar to the regenerative injection combustion. The combustion rate adjusts to match the injection rate as shown in FIG. 12C. This quasi-injection is seen in the thin sheet of liquid trailing behind the main part of the cavity. If combustion is too fast, the sheet burns out sooner, reducing the combustion surface area and the burn rate. If the burn rate is too slow, the sheet trails further behind the cavity, increasing its burning surface until equilibrium is achieved. Within the combustion zone, moving aftwardly from the gas-liquid interface, the velocity of the combustion gas increases and the pressure of the combustion gas decreases.

It may be noted that this integrated system provides an inherent delay in the ignition of the traveling charge since such ignition can not begin until after the substantial completion of the combustion of the initial, stationary charge.

The resultant traveling charge propellant burn rate therefore is controlled by the velocity of the cavity toward the projectile as they both move down-bore thus:

$$m = \rho_L A_{BORE} V_c$$

Where:
m = mass burn rate #/sec.
$\rho_L$ = propellant density #/ft$^3$
$A_{BORE}$ = Bore area ft$^2$
$V_c$ = Cavity Penetration Velocity The cavity advances into the traveling charge due to the buoyant force ($F_B$) acting on it:

$$F_B = 4/6\pi S_F D^3_{BORE} \rho_L - \rho_G) A$$

Where:
A = Acceleration (G's)
$\rho_G$ = Gas Density
$D_{BORE}$ = Bore Dia (ft)
$S_F$ = Shape factor (cavity volume compared to a sphere of Bore dia)

The motion of the cavity is resisted by the fluid as if it were a solid body. This drag force is:

$$D = \tfrac{1}{8} g \rho_L C_D \pi D^2_{BORE} V_c^2$$

Where:
$C_D$ = Drag Coefficient

Setting these forces equal allows us to solve for the penetration velocity of the cavity:

$$V_c^2 = \frac{8\, g\, S_F\, D_{BORE}\, (\rho_L - \rho_G) A}{6\, \rho_L\, C_D}$$

This can be simplified by recognizing that $\rho_L >> \rho_G$ and combining the constants:

$$V_c = K \sqrt{D_{BORE}\, A}$$

The acceleration of the projectile and traveling charge mass is obtained from:

$$A = \frac{P_B\, A_{BORE}}{(M_B + T_C)}$$

Where:
$P_B$ = Base Pressure
$M_B$ = Projectile Mass (#)
$T_C$ = Traveling Charge Mass (#)

If we assume base pressure is to be the same for all guns and we scale the projectile and traveling charge masses by $(D_{BORE})^3$ we get:

$$A \propto \frac{P_B}{D_{BORE}}$$

Thus $V_c$ is independent of scale.

If the burn rate is high enough, the base pressure is only a function of the burn rate thus:

$$P_B = \frac{F}{A_{BORE}}$$

-continued

Where:
$F$ = Total thrust
= $\mathring{m}\, I_{SP}$
$I_{SP}$ = Specific Impulse # sec/# acceleration now becomes:

$$A = \mathring{m}\, I_{SP}/(M_B + T_C)$$

$$= \frac{\rho_L\, A_{BORE}\, I_{SP}\, V_c}{(M_B + T_C)}$$

$$= \frac{\pi\, \rho_L\, D^2_{BORE}\, I_{SP}}{4(M_B + T_C)} K \sqrt{D_{BORE}\, A}$$

$$A = \frac{\pi^2\, P_L^2\, D^5_{BORE}\, I^2_{SP}\, K^2}{16\, (M_B + T_C)^2}$$

remembering that $(M_B + T_C) = CD^3_{BORE}$, we get:

$$A = \frac{\pi^2\, P_L^2\, I^2_{SP}\, K^2}{16\, C^2\, D_{BORE}}$$

or again $$A \propto \frac{1}{D_{BORE}}$$

The constants in these relationships may change with caliber but the principal effects scale in an acceptable way.

Figure 13A:
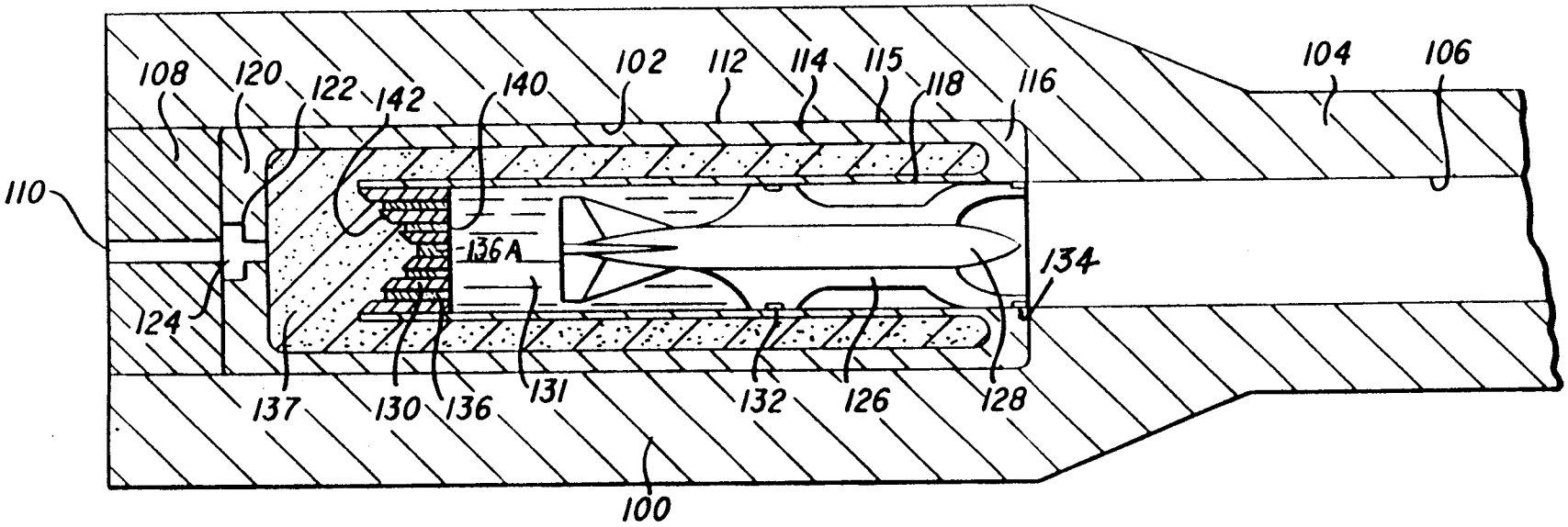
FIG. 13A is a view in longitudinal cross-section of hybrid solid and liquid propellant system embodying a second species of this invention, chambered and prior to ignition.
Figure 13B:
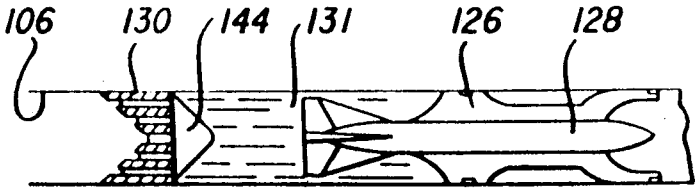
FIG. 13B is a schematic of the system of FIG. 13A during the traveling charge stage of operation.

A second embodiment of this invention is shown in FIGS. 13A and 13B. This embodiment is a gun having a solid propellant first stage and a liquid propellant second stage. Such a system may be referred to as a Hybrid Traveling Charge (HTC) propulsion system.

FIG. 13A shows a gun having a breech 100 with a chamber 102 and a gun barrel 104 with a bore 106, and a gun bolt 108 with a firing pin 110. A telescoped round of ammunition 112 is disposed in the chamber 102 which is closed by the gun bolt 108.

The round of ammunition comprises a case 114 with a main portion 115, a forward, tubular, return bend 116 providing a sleeve portion 118, and a base portion 120 with a bore 122 in which is fixed a primer 124. The outer diameter of the main portion 115 matches the inner diameter of the chamber 102. The inner diameter of the sleeve portion 118 matches the inner diameter of the bore 106. A sabot 126 with a projectile 128 is disposed in the forward portion of the sleeve portion 118. A cavity generator 130 is disposed in the aft portion of the sleeve portion 118. A charge 131 of liquid propellant is disposed in the sleeve portion forward of the generator and around the aft portion of the sabot. The intermediate portion of the sabot has an annular seal 132, and the forward portion of the sabot has a bore rider 134. The cavity generator 130 is also sealed to the sleeve, all to seal the charge of liquid propellant within the case 114. The interior volume between the sleeve portion 118 and the main portion 115 and the base portion 120 of the case is filled with a charge 137 of solid propellant (which may be consolidated to improve the packing efficiency).

The propulsion operation begins with the energization of the primer 124 by the firing pin 110 to ignite the solid propellant 137. As the pressure developed by the combustion gas rises, the gas pushes, i.e. accelerates the cavity generator 130, the sabot 126 with its projectile 128, and the captured charge of liquid propellant 131 forwardly, as a unit, into the gun bore 106.

As previously stated, a traveling charge provides improved performance when the ignition of such traveling charge is delayed until the projectile and such charge have achieved significant velocity. In this species, the cavity generator 130 serves to provide the necessary delay. The cavity generator, prior to firing, serves to seal the rear of the liquid propellant traveling charge 131 within the case 114. After ignition of the stationary charge of solid propellant 137 and prior to the ignition of the traveling charge of liquid propellant, the generator 130 serves to isolate the traveling charge 131 from the combustion gases generated by the stationary charge 137. The generator 130 has a plurality of longitudinal bores 136, each extending from a substantially flat transverse front face 140 to a substantially concave transverse aft face 142, so that the bores vary in length. These bores 136 are obturated respectively with a material 136A which has a density different from the density of the generator 130 and which is resistant to movement, e.g. grease or press-fitted pins. During the initial acceleration of the generator 130, this material does obturate the bores 136. The acceleration forces acting on this material serve to extrude the material forward or aftward from the generator depending on their relative densities. After a period of time during this period of initial acceleration, due to the combustion of the stationary charge 137, these bores 136 are thus sequentially opened in reverse order of their respective lengths. As shown in FIG. 13B, as these bores are opened, hot combustion gases pass forwardly through the bores to the rear face of the traveling charge of liquid propellant 131 to form an initial cavity 144 whose shape is substantially determined by the sequence in which the bores 136 open. The shortest bores in the center of the generator pass the gas first to form the deepest part of the cavity. Once formed, this initial cavity takes the shape of a stabilized Taylor Cavity as discussed with respect to FIG. 12A.

Figure 14:
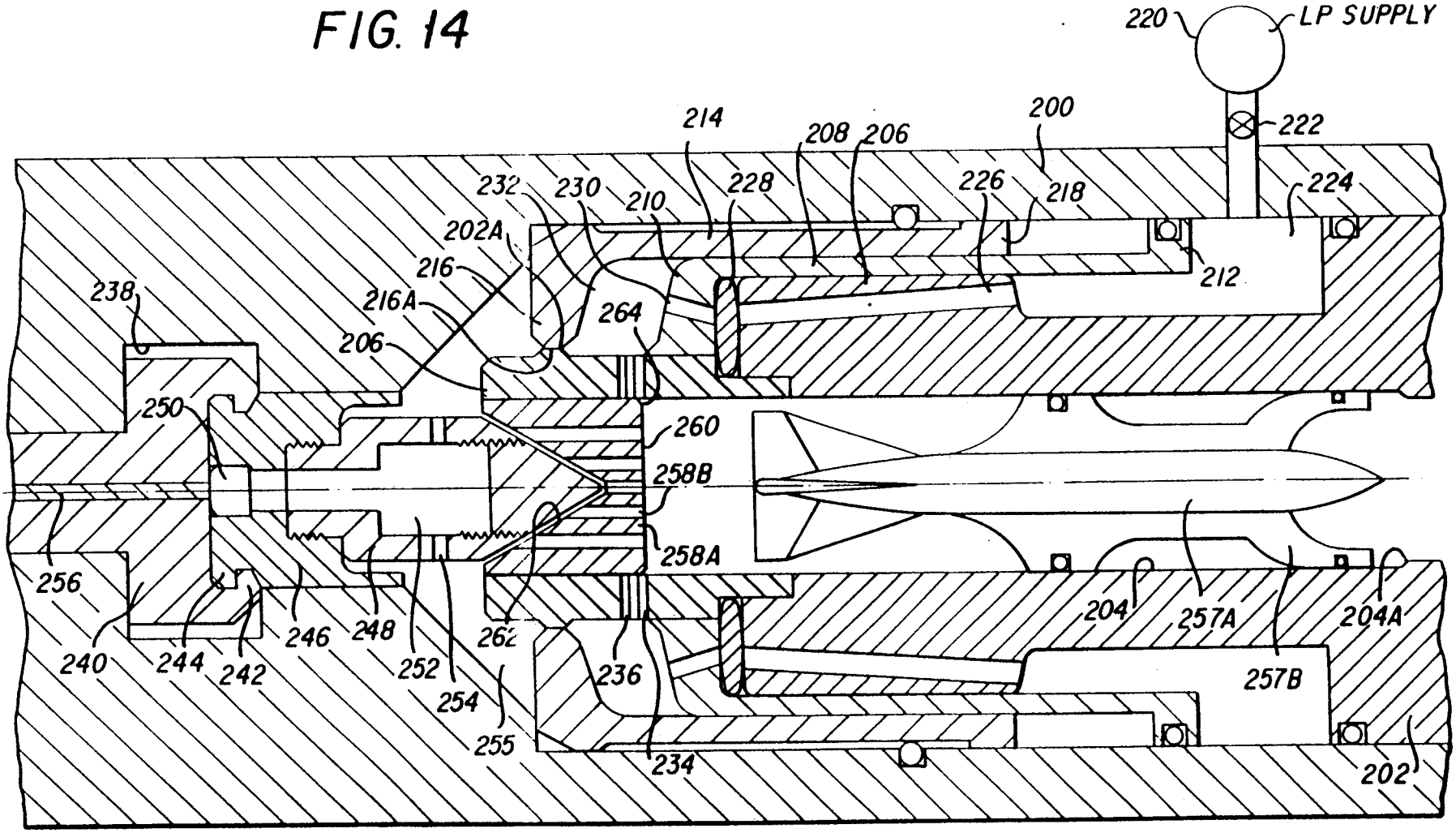
FIG. 14 is a view in longitudinal cross-section of liquid propellant system utilizing a cavity generator embodying a third species of this invention.

FIG. 14 shows a third embodiment of this invention. This embodiment is a gun which combines features of the first and second embodiments of this invention. The system includes a liquid propellant, regenerative injection, first stage, a liquid propellant, traveling charge, second stage, and a cavity generator to provide a delay prior to the ignition of the second stage.

This gun is similar to that shown by M. J. Bulman in Ser. No. 263,792 filed May 14, 1981 and includes a breech 200, to which is secured a gun barrel 202 having a bore 204. The gun barrel has an aftwardly projecting extension 206 on which is telescopically journaled an annular fill valve 208 having a head portion 210 and a tail portion 212. Telescopically journaled on the fill valve is an annular, regenerative piston 214 having a head portion 216 and a tail portion 218. A supply 220 of liquid propellant under pressure is coupled via an inlet valve 222 to a manifold 224 which communicates with an annular row of longitudinal bores 226 through the barrel extension 206. The bores 226 may be obturated by a snap-action valve 228 (e.g., a belleville washer) and otherwise communicate with an annular row of longitudinal bores 230 through the fill valve head portion 210. When the fill valve is in its forwardmost disposition its head portion is seated on the snap-action valve 228 to obturate the bores 226. When the regenerative piston is in its aftmost disposition, the inner rim 216A of its head portion is seated on an annular projection 202A of the barrel to define a pumping chamber 232 between the fill valve head portion and the regenerative piston head portion. Two annular rows 234 and 236 of radial bores through the barrel extension communicate between the pumping chamber 232 and the gun barrel bore 204.

The aft end of the breech has an opening 238 which is closed by a gun bolt 240 whose head rotates about its longitudinal axis to lock and unlock. The face of the bolt has a pair of extraction lugs 242 to engage the extractor rim 244 of a stub case 246 which carries a booster cartridge 248. The case has a primer 250 opening onto a conduit which leads to a booster charge 252 opening onto a plurality of radial bores 254, which open onto a combustion chamber 255 defined by the breech 200, the piston head 216, the barrel extension 206, and the cartridge 248. The gun bolt has a firing pin 256 to actuate the primer 250.

In loading the gun, the gun bolt may be withdrawn and a projectile, here shown as a rod penetrator 257A with fins carried in a sabot 257B, may be inserted. Subsequently a cavity generator 258A with a plurality of bores 258B, extending from a planar front face 260 to a concave aft face 262, and filled with an obturating medium, may be inserted. The front face may have an annular bevel 264, which when aligned with the bores 234 provides access from the pumping chamber 232 to the interface between the cavity generator and the projectile. Thereafter, the gunbolt, carrying a stubcase with a booster cartridge, is inserted into the breech opening and locked. The annular piston 214 may be in its aftmost position, with the surface 216A on the projection 202A. The annular fill valve may be in a forward disposition. The inlet valve 222 is opened to admit liquid propellant from the supply 220 under pressure into the manifold 224, through the bores 226, past the snap action valve 228, through the bores 230, into the pumping chamber 232, through the bores 234, into the interface between the cavity generator and the projectile, pushing the projectile forwardly until it is halted by the forcing cone 204A in the bore 204. An interface gap is provided between the forward face of the booster cartridge and the aft face of the cavity generator by suitable means, such as conical ridges on the booster face.

Upon ignition of the primer 250, hot gases are provided to ignite the booster charge 252 which in turn vents combustion gas through the bores 254 into the combustion chamber 255. The pressure of the combustion gas in the combustion chamber acts on the aft face of the differential piston head 216 to displace the piston 214 forwardly, and through the medium of the liquid propellant and bore 230 to close the snap action valve 228 to close the bores 226 and isolate the liquid propellant supply system from the pumping chamber. As the annulus 216A of the head 216 moves off the annulus 202A of the barrel extension 206, a progressively increasing annular gap or injection port is thereby provided through which liquid propellant is injected from the pumping chamber 232 into the combustion chamber 255.

Combustion gas passes into the interface gap between the cavity generator and the booster and acts on the aft face of the cavity generator to displace the cavity generator forwardly to close off the bores 234 and through the medium of the liquid propellant in the bore to displace the sabot with its projectile past the forcing cone 204A. In due course the assembly of cavity generator, traveling charge of liquid propellant and sabot and projectile is accelerated forwardly along the gun barrel bore 204.

When the cavity generator is forward of and clears the bores 234 and 236, liquid propellant is then pumped through these bores from the pumping chamber into the combustion chamber which now extends into the aft portion of the bore 204.

In due course all of the liquid propellant in the combustion chamber 255 and in the aft end of the gun barrel bore aft of the cavity chamber has combusted and the combustion gas generated thereby continues to expand and to accelerate the assembly. At this time the obturating medium is displaced from the bores 258B, initially from the shorter, inner bores and subsequently from the longer outer bores, to permit combustion gas to flow therethrough and to form a bubble of combustion gas at the forward face of the cavity generator. This bubble ignites the aft face of the traveling charge of liquid propellant and develops into a Taylor cavity as previously described.

Figure 15:
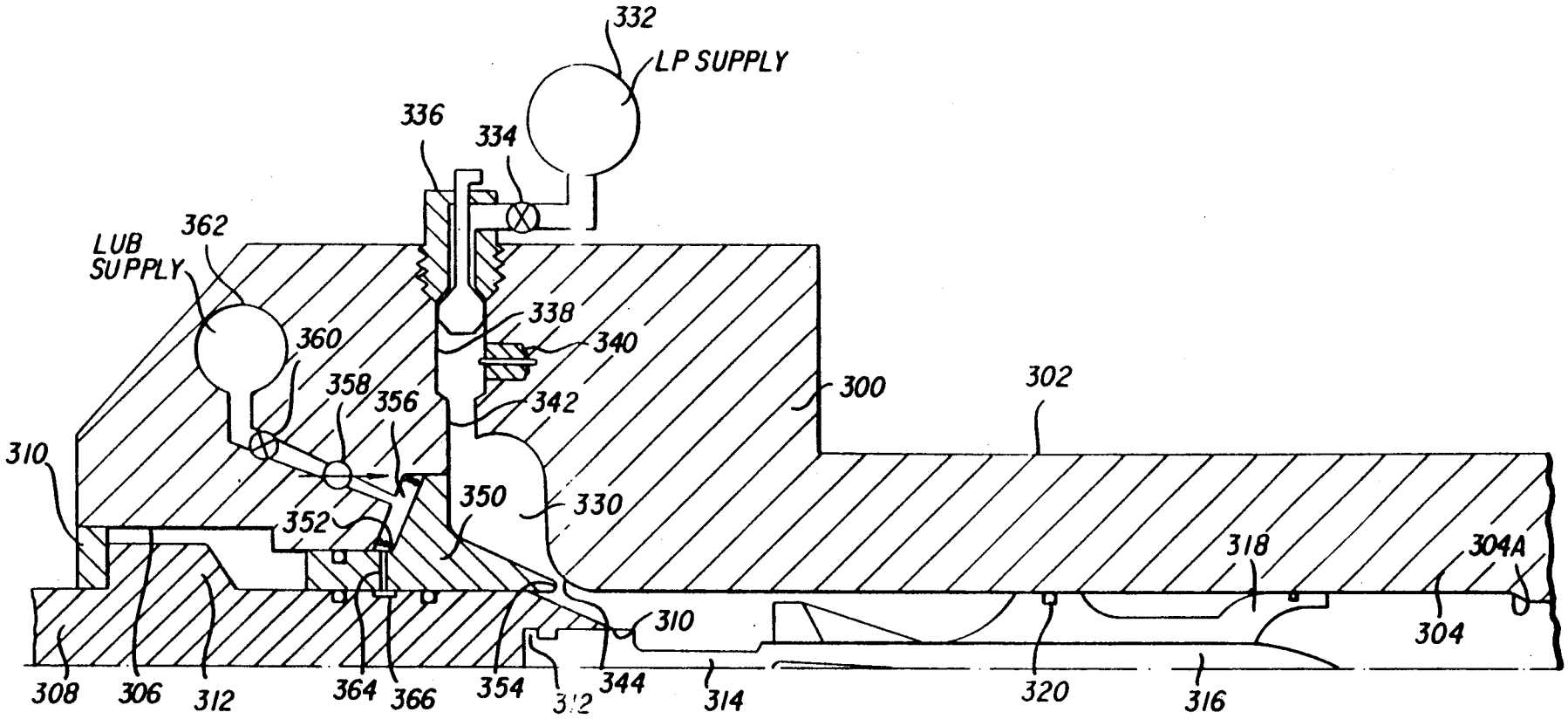
FIG. 15 is a view of a fourth species of this invention.

FIG. 15 shows a fourth embodiment of this invention. This embodiment is the most elemental embodiment of this invention comprising two combustion chambers. The system includes a liquid propellant, stationary combustion chamber and cavity generator and a liquid propellant, traveling combustion chamber.

This gun includes a breech 300 to which is secured a gun barrel 302 having a bore 304. The aft end of the breech has an opening 306 which is closed by a gun bolt 308 which is locked and unlocked to the breech by suitable means such as a movable lug 310 journaled to the breech to engage an annular lug 312 integral with the bolt. The forward end of the bolt 308 is formed as a truncated cone which has a channel 310 cut into it with an under cut 312 to receive the aft end of a "hold-back" or "shot-start" link 314. The forward end of the link is secured to the aft end of a projectile 316 which is fitted into a sabot 318 which has an annular seal 320.

An annular combustion chamber 330, coaxial with the gun barrel bore 304, is provided in the breech. A supply 332 of liquid propellant under pressure is coupled via an inlet valve 334 and a manifold to a pair of diametrically opposed ignition systems. Each system includes a unidirectional valve 336 to an ignition chamber 338 which has a spark plug 340 and an outlet 342 coupled to the combustion chamber. The combustion chamber has an annular outlet 344 having a conical shape directed into and forwardly along the gun barrel bore 304.

A projectile and sabot may be placed on the gun bolt by means of the link 314 and inserted through the aperture 306 into the gun barrel bore 304. In case it is desired to withdraw the projectile, as in the case of a misfire, the link 314 permits the gun bolt to provide this function also. The link may be designed to rupture when the projectile is subjected to a relatively high pressure, e.g., after ignition of the liquid propellant in the combustion chamber 330. Alternatively, the link may be designed to rupture at a relatively low pressure, e.g., upon inletting of liquid propellant under low pressure into the gun barrel bore from the combustion chamber. In this case, after rupture of the link, the inletted propellant advances the projectile and sabot until the sabot is halted by the forcing cone 304*a* in the bore.

In a preferred arrangement, an annular valve slide 350 is also provided. This slide is coaxial with and receives the forward portion of the gun bolt and also forms the aft wall of the combustion chamber. The slide is normally biased forwardly by a plurality of springs 352 so that its forwardly projecting lip 354, which forms the aft wall of an annular valve outlet 344, abuts the forward wall of the outlet to close the outlet. The springs are disposed in an annular pumping chamber 356 which is coupled via a variable orifice 358 and a unidirectional valve 360 to a supply 362 of lubricant under pressure. The chamber 356 is coupled, via an annular row of radial bores 364 through the slide, to an annular groove 366 in the gun bolt.

When liquid propellant is initially being pumped from the supply 332 into the pair of ignition chambers 338 and the annular combustion chamber 330, the slide 350 is in its forwardmost disposition, closing the valve outlet 344 of the combustion chamber. During this interval the gun bolt may be completing its loading of the projectile and sabot into the gun barrel bore and locking. When the combustion chamber is full of liquid propellant under pressure, the liquid pressure forces the slide aftwardly, against the bias of the springs 352, to open the annular outlet 344 to permit the flow of liquid propellant from the combustion chamber into the aft portion of the bore 304 up to the seal 320 on the sabot. This initial aftward movement of the slide forces some of the lubricant from the annular groove 356 into the interface between the gun bolt and the slide to provide an initial volume of lubricant, which also serve as a seal against combustion gas, in the interface. This seal is replenished during each firing cycle of the gun.

After the pair of ignition chambers 338, the combustion chamber 330, and the volume of the gun barrel bore 304 forward of the gun bolt and aft of the seal 320 have been filled with liquid propellant, the pair of spark plugs 340 are energized to ignite the liquid propellant in the ignition chambers. The pair of bubbles of combustion gas respectively enlarge and ignite the liquid propellant in the combustion chamber. As the gas pressure builds up in the combustion chamber the slide 350 is forced aftwardly to increase the volume of the combustion chamber from its initial minimum volume to its maximum volume to slow down the rate of increase in gas pressure. This final aftward movement of the slide also forces more lubricant from the annular groove 366 into the interface between the gun bolt and the slide. It will be seen that the seal between the gun bolt and the slide is thus renewed for each firing of a round. The expanding combustion gas flows through the valve outlet 344 and into the gun barrel bore both (i) pushing the volume of liquid propellant therein and thereby the projectile and sabot forwardly past the forcing cone and (ii) consuming the aft face of that volume as a Taylor cavity. All of the charge of liquid propellant in the stationary combustion chamber 330 should be combusted before the traveling charge of liquid propellant in the gun barrel bore aft of the seal 320 carried by the sabot is ignited so as to control the peak pressure developed in the combustion system. As the traveling charge progresses forwardly along the gun barrel bore that portion of the bore in which it is disposed may be considered to be a combustion chamber, ergo, the traveling charge is disposed in a traveling combustion chamber.

As indicated earlier, the link 314 may be made stronger so that the projectile is thereby held to the gun bolt throughout the period of filling with propellant and after ignition until some desired pressure, such as 5,000 psi or higher is developed in the combustion system.

Figure 16:
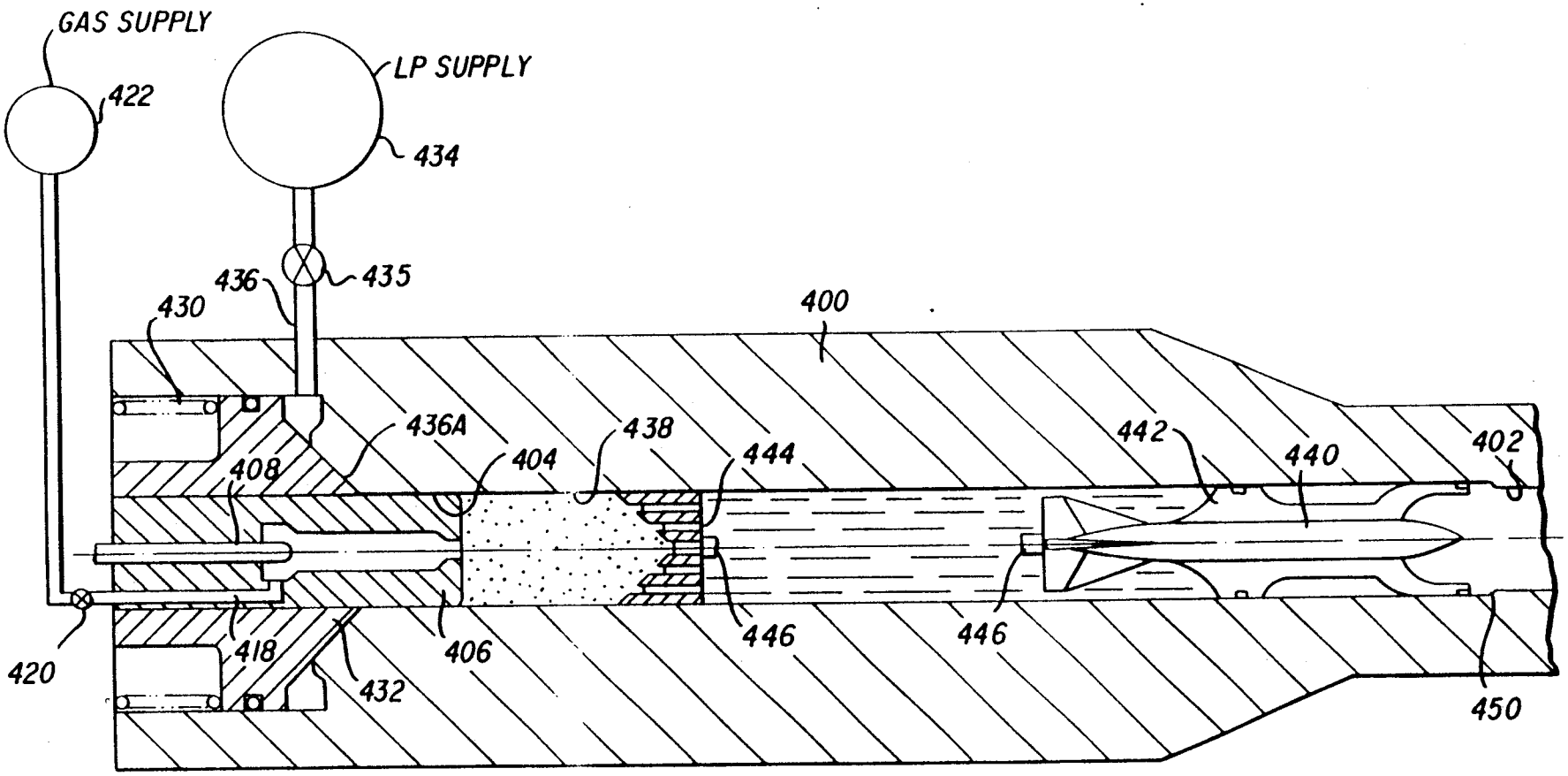
FIG. 16 is a view of a fifth species of this invention.

FIG. 16 shows a fifth embodiment of this invention. This embodiment utilizes a technique for providing a two phase mixture of droplets of liquid propellant and a gas for the first stage propulsion. This technique is disclosed in U.S. Pat. No. 4,050,348, issued Sept. 27, 1977 to A. R. Graham, the disclosure of which is hereby incorporated by reference.

The gun system includes a housing 400 which extends forwardly into a gun barrel having a gun bore 402 and aftwardly into a breech having an opening 404 which is closed by a gun bolt 406. The gun bolt may have seals and an electrode 408 in an ignitor cavity as shown in U.S. Pat. No. 3,783,737, issued Jan. 8, 1974 to E. Ashley, the disclosure of which is hereby incorporated by reference. A conduit 418, having a unidirectional valve 420, couples a supply 422 of gas, such as nitrogen or air, to the ignitor cavity. A spring 430 loaded piston 432 operates in the housing as a fill valve to couple a liquid propellant fill system 434 via a valve 435 and a conduit 436 into the aft end 438 of the gun bore.

When the gun bolt is withdrawn, an assembly, consisting of a projectile 440 carried by a sabot 442 and a cavity generator 444 fixed to the projectile by a frangible link 446, may be inserted into the aft end 438 of the bore so that the cavity generator is aft of the opening 436A of the conduit 436 into the bore and the projectile is forward thereof. The gun bolt is then inserted to a first position to back up the cavity generator. The spring loaded piston 432 is moved aftwardly, to open the fill valve, by applying liquid propellant under pressure from the liquid propellant supply 434. Liquid propellant then flows into the volume between the cavity generator and the projectile. The ullage air contained therein is compressed and the projectile urged forwardly until the frangible link is broken. As liquid propellant continues to enter the volume the projectile moves forwardly until the full metered charge is entered and the fill valve closes. Aftward movement of the cavity generator is blocked by the gun bolt. The valve 420 is now opened to admit gas under pressure from the supply 422 into the igniter cavity and this gas acts on the aft face of the cavity generator 444 to advance the train of generator, liquid propellant, and projectile and sabot forwardly until the sabot is halted by the forcing cone 450 in the gun barrel. When the gas flow pressure reaches a predetermined level, the valve 420 is closed. A metered volume of liquid propellant is again applied, under pressure greater than the gas pressure, through the fill valve into the volume aft of the cavity generator. As the liquid propellant flows into the gas under pressure, it is sheared into droplets. The gun bolt is then moved forwardly to compress the two phase mixture of gas and droplets of liquid propellant, and then locked. A voltage is applied to the electrode 408 to ignite the two phase mixture in the ignition cavity and the ballistic cycle proceeds as discussed in the other embodiments.

I claim:

1. A mode of operation for a round of annumition which includes in sequential train, a projectile, a volume of liquid propellant, a cavity generator, a volume of solid propellant and a primer:

said primer, when detonated, serves to ignite said volume of solid propellant to provide a volume of combustion gas;

said volume of combustion gas serves to forwardly accelerate said cavity generator, said volume of liquid propellant and said projectile;

said cavity generator, during acceleration, serves to pass combustion gas through said cavity generator to the aft face of said volume of liquid propellant to ignite, and to form a Taylor cavity in, said liquid propellant.

* * * * *